United States Patent [19]

Tsuchiya et al.

[11] Patent Number: 4,944,283

[45] Date of Patent: Jul. 31, 1990

[54] GAS BURNER

[75] Inventors: Mitsuo Tsuchiya, Nagoya; Masafumi Matsubara, Owariasahi; Yoshihiro Mori, Kuwana; Hideo Itami, Nagoya, all of Japan

[73] Assignees: Paloma Kogyo Kabushiki Kaisha; Toho Gas Co., Ltd., both of Nagoya, Japan

[21] Appl. No.: 399,899

[22] Filed: Aug. 29, 1989

[51] Int. Cl.[5] ..... A47J 37/00; F24C 3/00

[52] U.S. Cl. ..... 126/41 R; 126/21 R; 126/299 R; 110/203; 110/210

[58] Field of Search ..... 126/21 R, 21 A, 19 R, 126/299 R, 299 D, 41 R, 39 R, 39 J, 39 K, 312; 431/329, 328, 326; 422/177; 110/203, 210, 211

[56] References Cited

U.S. PATENT DOCUMENTS

| | | | |
|---|---|---|---|
| 3,428,435 | 2/1969 | Hurko et al. | 126/21 R |
| 4,113,439 | 9/1978 | Ookubo et al. | 126/299 R |
| 4,676,221 | 6/1987 | Bayne et al. | 126/41 R |

FOREIGN PATENT DOCUMENTS

| | | | |
|---|---|---|---|
| 2817101 | 10/1979 | Fed. Rep. of Germany | 126/21 R |
| 122210 | 7/1982 | Japan . | |

*Primary Examiner*—James C. Yeung
*Attorney, Agent, or Firm*—Lahive & Cockfield

[57] ABSTRACT

A gas burner assembly including a main burner, a catalyzer and an after burner has a fire guide formed on a boundary between porous flame plates.

4 Claims, 3 Drawing Sheets

GAS BURNER

BACKGROUND OF THE INVENTION

1. Field of the Invention

This invention relates to the field of gas burners particularly of gas ovens or gas heaters for cooking use.

2. Description of the Prior Art

In such a conventional cooking-use gas burner as described above, shown in FIG. 1 and FIG. 2, in the grill chamber 10, a water tray 44 with the front panel 13 slidable in the removable drawer 42 is disposed. A grill 17 is put in the water tray 14, whereover a main burner 1 and a series of heat plates 15 are disposed. The heat plate 15 is heated by the main burner 1, thereby producing radiant energy which bakes food on the grill 17. In addition, a chimney 18 is mounted on the top of the inside of the grill chamber 10. An after burner 2 is installed on a place adjacent to the outlet of said chimney 18. A catalyzer plate 19 for deodorizing and desmoking is disposed at the outlet of the chimney. The after burner 2 burns smoke and exhaust gas collected in the chimney and heats the catalyzer up to the required temperature activating said catalyzer in the optimum condition, thereby deodorizing and desmoking effectively. A pilot burner 3 equipped with a first nozzle 5 and second nozzle 6 is disposed between the main burner 1 and after burner 2. The flame 7 from the first nozzle 5 of the pilot burner 3 contributes to the ignition of the main burner, while the flame is guided through the fire guide 4 to ignite the second nozzle 6 and the subsequent after burner 2.

SUMMARY OF THE INVENTION

An object of the present invention is an improved gas burner in which the main burner is integrally comprized with the after burner, a fire guide formed on a part therebetween.

A more particular object of this invention is to provide a minimum ignition point without an auxiliary burner for a fire guide means, which contributes stable ignition without explosional danger.

More specially, an object of the present invention is a stable fire guide means.

Another object of this invention is to provide a shape gas burner with an integral combination of a main burner and after burner, which enhances the function and easy installation of said gas burner.

Another object of this invention is to provide a compact and simple gas burner with the reduction of the number of component.

Briefly, these and other objects of the present invention are realized in a specific illustrative gas burner embodiment thereof that comprises the main burner integrally with the after burner together with a fire guide disposed thereupon. The purpose of the after burner is to activate a catalyzer eliminating odor and smoke contained in the combustion exhaust gas and to directly burn and oxidize such exhaust gas.

In addition, the burner system is totally comprised in such a structure that two main burners disposed in parallel each other are formed integrally with the after burner in a U-shape. Preferably the width of the after burner should be the same size of the chimney width.

For the use of such comprized gas burner in the grill of the cooking gas heater, the main burner is disposed just above the grill and while, the after burner is installed a place adjacent to the outlet of the chimney.

Then, the main burner bakes food on the grill and the after burner burns the exhaust gas containing smoke and odor as well as heating the catalyzer at the outlet of the chimney upto the required temperature to maintain the optimum activation of the catalyzer that effectively absorbes residual odor and smoke contained in the exhaust gas.

Advantageously the main burner is formed integrally with the after burner, wherein a fire guide means formed on a part of the arrangement of the nozzle, for instance, when an igniting means such as the ignition plug installed on the center of the after burner ignites the after burner, the flame is quickly and positively guided to the main burner and ignites it.

It is a feature of the present invention that the main burner is integrally formed with the after burner in the U-shape.

It is a further feature of this invention that the width of the after burner is nearly same as that of the chimney, under which each burner functions enough and is easy in installation.

It is another feature of the present invention that the structure of the burner and piping becomes simple.

DETAILED DESCRIPTION

Figure 1:
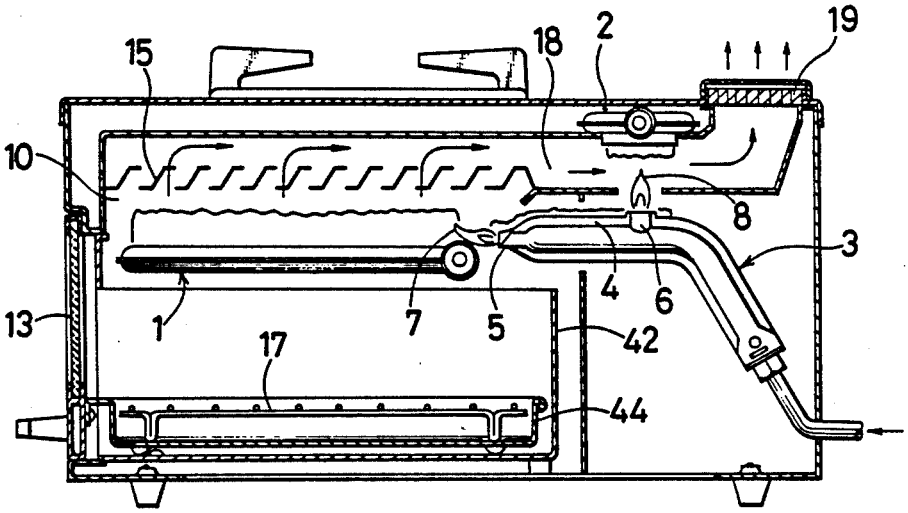
FIG. 1 ( PRIOR ART )
FIG. 1 is a longitudinal sectional view of a known burner system for cooking gas heater.
Figure 2:
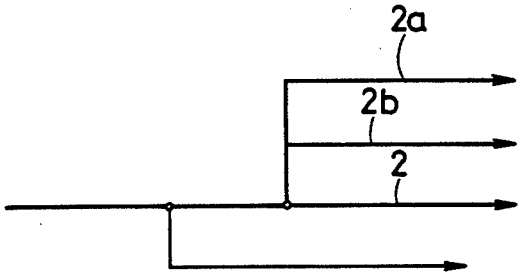
FIG. 2 ( PRIOR ART )
FIG. 2 is a piping diagram of the known burner system of FIG. 1.
Figure 3:
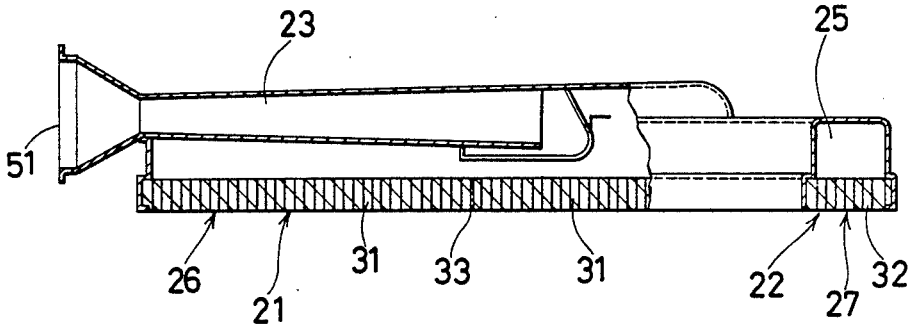
FIG. 3 is a vertical sectional view of a gas burner of the present invention.
Figure 4:
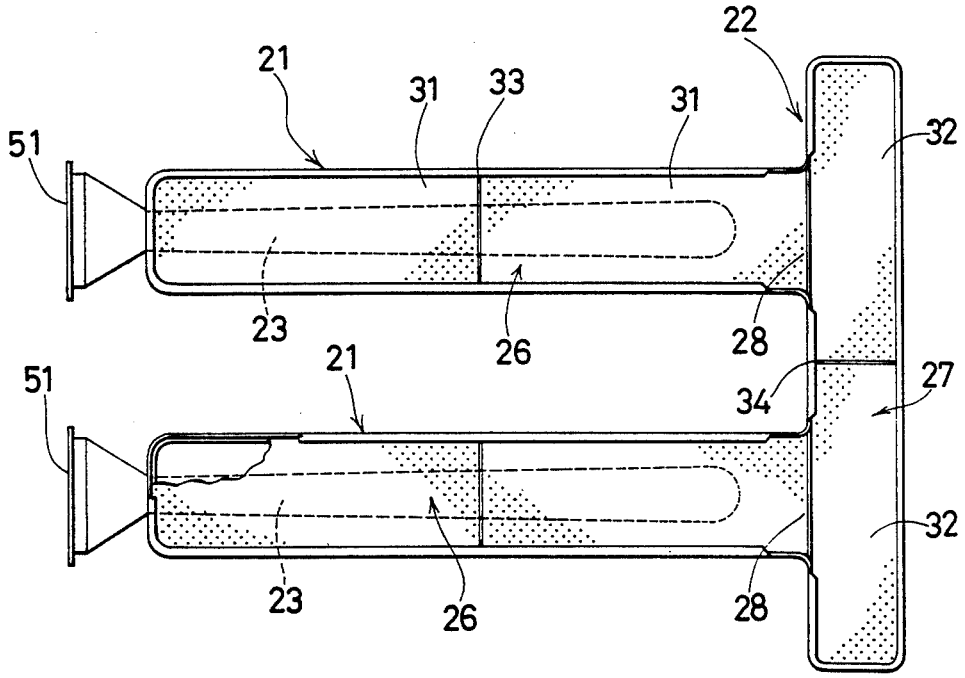
FIG. 4 is a plain view, almost sectional, of FIG. 3.

As shown in FIGS. 3 and 4, there are illustrated a gas burner system installed in the grill housing of a gas cooking heater. Two main burners 21 and 21 are disposed in parallel each other. The mixture pipe 23 is connected to each main burner of 21 and 21 to supply air-gas mixture. The after burner, for activating a catalyzer to absorb odor and smoke contained in the exhaust gas and for burning such odor gas and smoke to eliminate them, is integrally associated with said two main burners 21 and 21 at their ends in the T-shape. Said mixture pipe 25 is also communicated with the main burners 21 and 21 and a mixture pipe 23 of the main burner 21 and 21. The main burners 21 and 21 are disposed in a T-shape against the after burner 22, with a fire guide means 28 formed on the boundary between the porous flame plate 26 of the main burners 21 and 21 and the porous flame plate 27 of the after burner 22, which is totally integrally formed in shape. The width of the fire guide means 28 may be narrower than that of the main burners 21 and 21 or the same as that one.

The two main burners 21 are arranged as parallel legs, with the after burner consituting a cross-member connected perpendicularly to both main burners at one end, and extending slightly past each main burner in a projecting stub, thus reassembling the Greak letter $\pi$ turned sideways. This assembly may be fabricated as a relatively flat chamber or assembly with a common plate closing one side of the chamber to provide the flame region of each burner.

In the embodiment of the present invention, a porous ceramic infrared plate is used for the porous flame plate 31 of the main burners 21 and 21 and the porous flame plate 32 of the after burner 22. The porous seramic infrared plate 31 of the main burners 21 and 21 and the porous seramic infrared plate 32 of the after burner 22 are divided into two parts respectively. A seramic fiber 33 is interposed between the divided two porous seramic infrared plates 33 and 33. Similarly, the seramic fiber 34 is interposed between the divided two porous seramic infrared plates 34 and 34. A non-divided porous seramic plate may be used for said seramic plates 31 and 32. The gas burner of the present invention is not limited to the above described porous ceramic infrared combustion burner.

Figure 5:
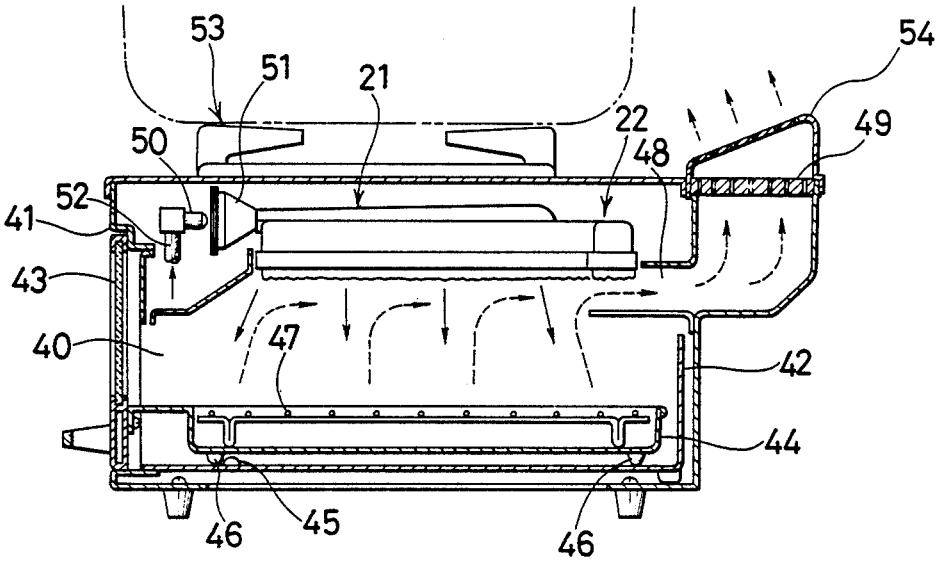
FIG. 5 is a longitudinal sectional view of an application of this invention.
Figure 6:
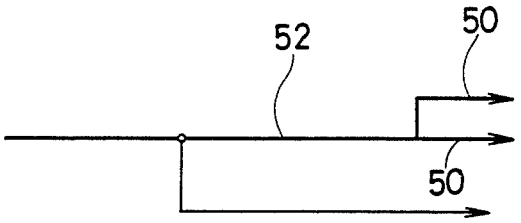
FIG. 6 is a piping diagram of FIG. 5.

Referring now to FIG. 5 and FIG. 6, there is an application of the gas burner of the present invention, of which the burner is used in the grill housing of the gas heater for cooking use: In the grill chamber 40, the water tray 44 integrally composed with the front panel 43 is put on the case 42 removable from the front opening 41, in which the stoppers 45 and 46 restrict the drawing span thereof, that is totally formed in a double drawer. A grill 47 for baking food is put on the water tray 44. Main burners 21 and 21 are provided above said grill 47, so that food is to be baked by the radiant heat from said main burners 21 and 21.

While, an after burner 22 disposed at a place adjacent to the outlet of the chimney 48 installed on the top of the grill housing 40 burns out smoke and odor gas contained in the exhaust gas passing through the chimney, and also heats a catalyzer plate 49 upto the optimum temperature to continually actuate said catalyzer plate 49 desmoking and deodoring effectively.

A gas intake nozzle 50 is disposed at a place adjacent to the primary air inlet 51 formed at the end of a mixture pipe 23 of the main burner 21. The fuel gas from the gas intake nozzle 50 is mixed with fresh air from the primary air inlet 51 of said mixture pipes 23 and 25 and then, the fuel-air mixture is equally supplied to the porous seramic plate 31 of the main burner 21 and the porous seramic plate 32 of the after burner 22. Where, the pipe 52 is for the gas intake nozzle 50. The support 53 is for pots and kettles. The cover 54 is for the catalyzer plate 49.

As described above, this gas burner is integrally composed of the main burners 21 and 21 with the after burner 22 in the shape of and the width of the after burner 22 is nearly equal to that of the chimney 48. When the burner system is installed on the top of the inside of the grill chamber, the main burners 21 and 21 are located just over the grill 47 and the after burner 22 is placed near the outlet of the chimney 48. Then, the food on the grill 47 is properly baked by the radiant heat from the main burners 21 and 21 and the smoke and odor produced from the baking food is collected into the chimney 48 together with the combustion exhaust gas from the main burners 21 and 21. The exhaust mixture flows toward the outlet, which is burnt out in the after burner 22 of nearly same in width as the chimney. The combustion is to preliminarily burn out oil smoke which may cause the clogging in the catalyzer plate 19 and to decomposite odor gas. The combustion of the after burner 22 also heats the catalyzer plate 49 to the optimum temperature for its activation and to maintain said catalyzer plate deordering and desmoking effectively. The residual smoke and odor gas contained in the exhaust gas is completely abosorbed by the activated catalyzer plate 49 when the exhaust gas flows therethrough.

Now, flame is quickly and positively guided from the after burner 22 to the main burner 21 and 21 through the fire guide 28 formed on the boundary between the porous flame plate 31 of the main burner 21 and the porous flame plate 32 of the after burner 22.

Although a specific embodiment of the present invention has been shown and described about the use in the grill of the gas heater, it is obvious that many applications on gasovens or other gas appliances are possible. The invention, therefore, is not intended to be restricted to the exact showing of the drawing and description thereof, but is considered to include reasonable and obvious equivalents.

What is claimed is:

1. A gas burner comprising a main burner for cooking food, a catalyzer for absorbing smoke, odor and other gases contained in combustion exhaust gas, an after burner positioned at a lower level than the catalyzer and located in a position upstream of the catalyzer for activating the catalyzer to burn out smoke, odor and other gases contained in the combustion exhaust gas, and a fire guide, said main burner, after burner and fire guide being formed as an integral unit, said main burner and said after burner each having a porous flame plate through which gas passes to form a combustion area, and wherein the fire guide is formed on a boundary between the porous flame plate of said main burner and the porous flame plate of said after burner.

2. The gas burner of claim 1, wherein said unit comprises an integral housing to which the porous flame plates are connected to constitute said main burner and said after burner, and wherein the porous flame plate of said after burner is positioned in a T shape across the end of each of two parallel porous plates of the main burner, said two parallel porous plates and the porous flame plate of said after burner forming a U-shape.

3. The gas burner of claim 1, wherein the catalyzer is positioned in a chimney, and said after burner has a width which approximates the width of the chimney, and is located at an entrance to the chimney.

4. The gas burner of claim 2, wherein the catalyzer is positioned in a chimney, and said after burner has a width which approximates the width of the chimney, and is located at an entrance to the chimney.

* * * * *